United States Patent [19]

Kopelman

[11] Patent Number: 4,911,379

[45] Date of Patent: Mar. 27, 1990

[54] INFLATED BALLOON RELEASE DEVICE

[76] Inventor: Shari D. Kopelman, 121 Fountain Ave., Rockville Centre, Long Island, N.Y. 11570

[21] Appl. No.: 299,662

[22] Filed: Jan. 23, 1989

[51] Int. Cl.[4] ..... B64B 1/58; A63H 27/10

[52] U.S. Cl. ..... 244/31; 244/98; 116/210; 116/DIG. 9; 141/313; 141/114; 446/220

[58] Field of Search ..... 244/31, 33, 98; 446/220, 224, 222; 116/210, DIG. 9, 102, DIG. 14; 40/214; 141/313, 114, 197, 314–317, 137, 167, 10, 4

[56] References Cited

U.S. PATENT DOCUMENTS

| | | | |
|---|---|---|---|
| 1,768,327 | 6/1930 | Nichols | 141/197 |
| 3,154,050 | 10/1964 | Hanson | 116/210 |
| 3,380,490 | 4/1968 | Ellenberg et al. | 141/314 |
| 3,536,110 | 10/1970 | West | 141/313 |
| 3,735,723 | 5/1973 | Lutz | 116/210 |
| 3,973,603 | 8/1976 | Franz | 141/313 |
| 4,564,159 | 1/1986 | Hill et al. | 244/31 |
| 4,795,112 | 1/1989 | Hashimoto | 244/31 |

*Primary Examiner*—Galen Barefoot
*Attorney, Agent, or Firm*—William T. Hough

[57] ABSTRACT

While the broad invention is directed to a device automatically releasable of a balloon when a predetermined degree of inflation has been achieved, in a preferred combination there is included the inflatable balloon, the balloon being restrained by a restraining mechanism until inflation by a lever mechanism when moved beyond a predetermined point representing the degree of balloon inflation desired, causes the restraining mechanism to release the balloon, and the restraining mechanism including a biasing spring to facilitate rapid release, together with the balloon gas-input spincter rubber valve having inserted therethrough a gas-inflating needle providable of inflating gas from a compressed or pressurized gas source or gas container contained in an open-top box having a lid, until the opening of the lid actuates a gas-release valve to inflate the balloon; release of the inflated balloon facilitates the pulling of the balloon's spincter rubber valve off-of the gas-inflating needle, the gas being preferably lighter than air such that the balloon floats upwardly when inflated and released from the box.

12 Claims, 3 Drawing Sheets

FIG. 2
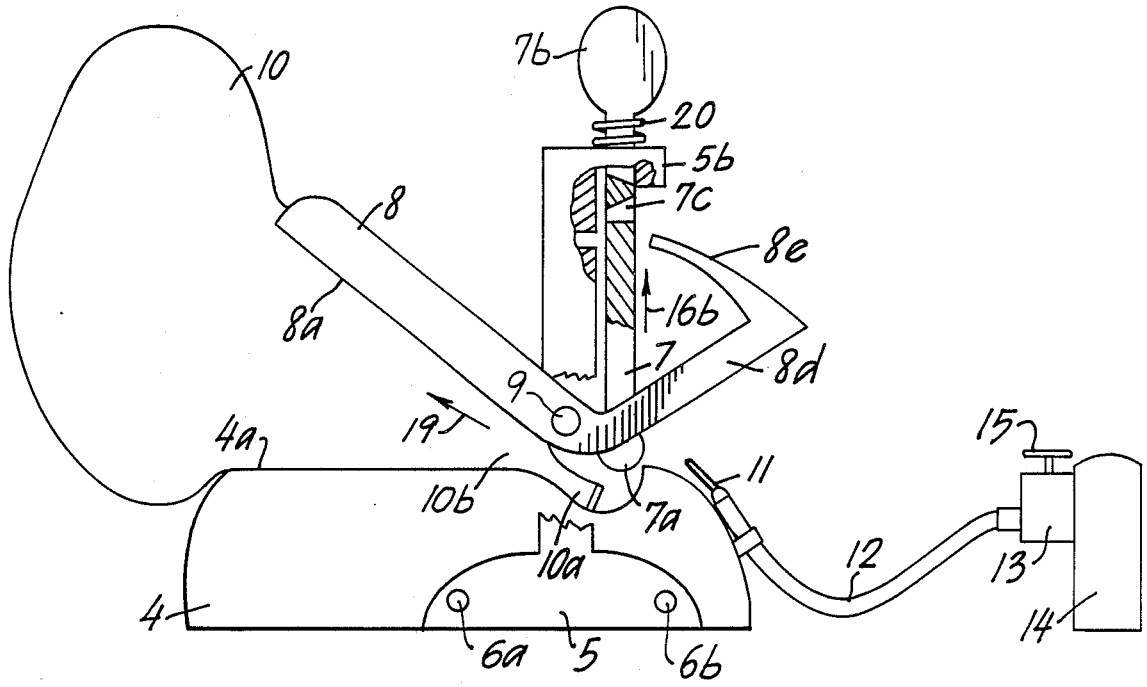
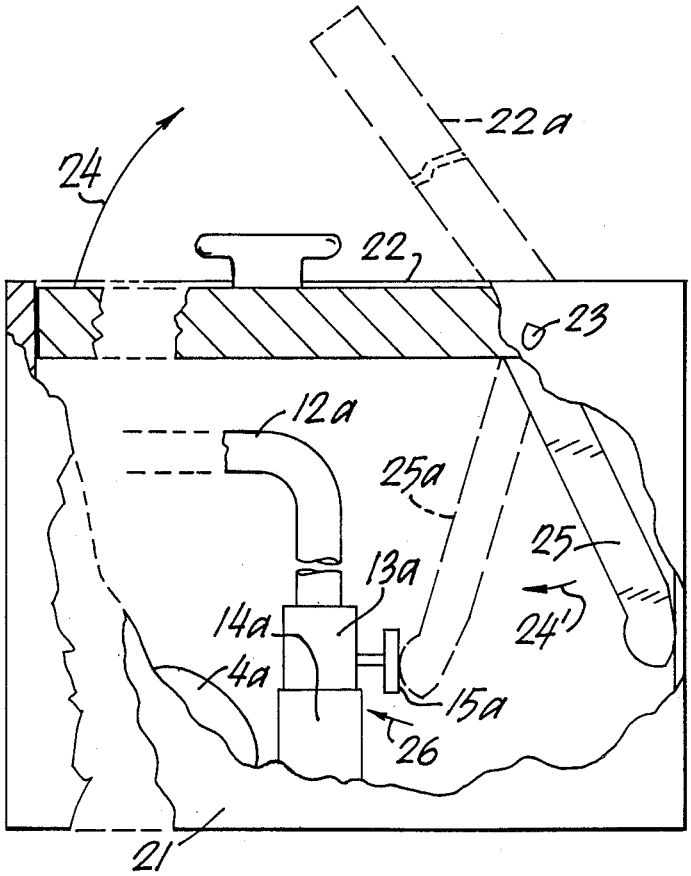
FIG. 3

INFLATED BALLOON RELEASE DEVICE

This invention is directed broadly to a novel balloon-release device, and more preferably to its combination with an inflatable balloon.

PRIOR ART

No prior art has been located that is directed to the same nor similar objects and achievements of the present invention. The sole prior art relates to other combinations together with their associated limitations and requirements, as contrasted to the present invention.

Typical prior art relating to restraining and release of balloons include the manually-releasable balloons and assorted kits as follow. In the U.S. Pat. No. 4,696,252 dated Sept. 29, 1987, a gas-release valve for release of helium into a deflated signaling-balloon, is actuatable by any of diverse parts of the person's body. U.S. Pat. No. 3,123,842 dated Mar. 10, 1964, a nut 46 with its magnesium washer 48 block radial movement of a locking pin, and only after manually causing the combination thereof to be launched into salt water of the sea, does the interaction of salt water and magnesium and steel cause the mechanism to eventually release pressurized gas if and when sea water-pressure is sufficient to activate the gas-release valve thereof. Manually-activatable release valves are utilized in each of the U.S. Pat. No. 4,2995,438 dated Oct. 29, 1981, U.S. Pat. No. 4,586,456 dated Oct. May 6, 1986, U.S. Pat. No. 4,094,267 dated June 13, 1978, and U.S. Pat. No. 3,964,427 dated June 22, 1976.

BACKGROUND TO THE INVENTION

Prior to the present invention, in the matter of having packaged helium-containing inflated "party"-balloons, which spring upwardly from a containing box or container when normally the lid or top of the box or container is opened, after typically untieing the party-ribbons thereon, thereby creating a festive atmosphere. A major disadvantage to the sole above-noted party-balloon package is that the individual inflated balloon each and all occupy so great a volume that it is necessary to utilize a large box or other large container for containing the party-balloons in the balloon-releasing box or container. While size might not seem such an important matter in some businesses, the large size of such party boxes raise particular problems to both the purchasing public as well as to the sellers who often sell such party balloon packages by mail order for shipment by mail.

Moreover, heretofore based on current technology, there has not existed nor has it been possible to make such packages small, without the sacrifice of reducing the number and/or size of balloon(s).

OBJECTS OF THE INVENTION

Accordingly, objects of the invention include the ovecoming of the aforestated problems and difficulties and disadvantages associated with the sale and merchandizing and shipping of balloon party-boxes.

More particularly, an object of the present invention is to provide a novel device for automatic inflation of one or more balloon upon the opening of a box or other container.

Another object is to provide a device which facilitates and enhances automatic stripping-off of an inflated balloon from an inflating needle.

Another object is to provide a device which prevents stripping-off of an inflated balloon prior to the balloon becoming fully inflated to a predetermined desired degree of inflation.

Another object is to provide a device automatically activatable of a gas-release mechanism of a compressed-gas container, upon the opening of a container or lid or door thereof.

Other objects become apparent from the preceding and following disclosure.

SUMMARY OF THE INVENTION

Broadly the invention may be described as a combination embodying a balloon-restraining and release mechanism that includes a balloon-restraining structure in operative association with a lever. The balloon-restraining structure is positioned to restrain a deflated inflatable balloon before and during inflation thereof. The lever is either directly or indirectly connected to the balloon-restraining structure and is functionally positioned and mounted such that the lever is adapted to be moved to a release position and state at which the balloon-restraining structure becomes instantaneously releasable of balloon(s) restrained thereby, and the balloon-restraining mechanism being initiatable of movement of the lever toward its release position and state by virtue of pressure of an exterior surface of the balloon against said lever, such that the lever moves the restraining structure from its balloon-restraining position and state.

In a preferred embodiment, there is included one or more substantially deflated inflatable balloons of which one or more thereof has its exterior surface positioned against said lever functionally to exert pressure against and to move the lever as above-noted when inflating gas is directed into the balloons. This preferred embodiment includes a gas-inflating mechanism that includes a pressurized-gas enclosing-structure enclosing pressurized gas. The pressurized-gas enclosing-structure has an outlet conduit and outlet port thereto and a gas container gas-release valve thereto. The gas container gas-release valve has a gas-release mechanism which when actuated, brings-about the release of the pressurized gas through the outlet conduit port. The outlet conduit is in a sealed gas-flow communication with the balloon gas-inlet port such that gas released by the gas-inflating mechanism is inflatable of the inflatable balloon(s) sufficiently to cause the lever to be moved to a degree releasable of the balloon-restraining and release mechanism up to a time and state of inflation of the balloon at the time of release thereof from the restraint by the balloon-restraining and release mechanism.

In another preferred embodiment, the inflatable balloon(s) each included an inflatable portion and a tubular gas inlet stem-portion that has the above-noted balloon gas-inlet port, and that includes a sealed inner-balloon space within the balloon-enclosing walls. Additionally, this preferred embodiment includes a self-sealing member—such as elastomeric composition or rubber or latex or the like, mounted fixedly and sealably within the balloon gas-inlet port, typically by virtue of resilient elasticity of the balloons constricting walls of the balloon gas-inlet port holding the self-sealing member sealably and tightly within the channel wall of the tubular gas inlet stem-portion. However, adhesive anchoring composition may alternately or in combination be used to assure a sturdy anchoring and sealing of the self-sealing member within (i.e., at) the balloon gas-inlet port.

This preferred embodiment additionally includes a gas-conveying tubular member enclosing tubular through-space. The tubular member has a proximal end portion having a proximal gas-entering opening therein, and has a distal gas-exiting portion having a distal gas-exiting opening therein. The distal end portion is mounted in and substantially extending from space exterior to the inflatable balloon through the self-sealing member. The inflating gas is sufficiently conveyed through the tubular member to exit from the gas-exiting opening as to pass inflatably into the sealed inner balloon space. The tubular member is withdrawable from the self-sealing member—i.e the self-sealing member and the balloon mounting the self-sealing member are withdrawable from the tubular member, and the self-sealing member is of a composition having physical properties such that it is self-sealing in the nature of a spincter valve, whenever the self-sealing member is removed from the tubular member, such as when the inflatable balloon(s) is/are inflated sufficiently that outer or exterior surface(s) of the balloon(s) exert sufficient pressure of an ascertained or predetermined magnitude against the lever(s) as to cause the balloon(s)'s stem-portion(s) and gas-inlet port(s) and self-sealing member(s) to be stripped-from the tubular member(s) after the restraining structure(s) has/have been released to a balloon-release position.

In another preferred embodiment, as a part of the combination, the gas contained in the pressurized-gas enclosing structure is a gas or mixture of gases, that is/are lighter than air, such as helium for example. More preferably, a predominant amount of the gas is helium.

In a further preferred embodiment, as a part of the combination there is an enclosing vessel having a vessel open port, and a lid member of a size and shape adapted to fit and intermittently close the open port when the lid member is in a vessel-closing state and position. The lid is positioned relative to the gas release mechanism, such that the gas release mechanism becomes actuated when the lid member is moved to a substantially open position and state, either by the lid member affording required pressure when in the open state, or alternatively by the lid member relieving required pressure-relief, in order for the gas release mechanism to become actuated to a gas-releasing position and state.

In a further preferred embodiment, there is included one lever(s) or the balloon-restraining structure(s) includes a key-portion; remaining-one of the lever(s) and the balloon-restraining structure(s) includes a key-receiving portion intermittently and withrawably receivable of the key-portion. The key-portion is lockably within the key-receiving portion when each of the lever and the balloon-restraining structure are in a positions and states at which the balloon is not released, i.e. when the balloon(s) is/are still restrained. That is to say, the key-portion remains in the key-receiving portions until the lever has been moved sufficiently that the balloon-restraining structure is in a balloon-release position and state.

In a further preferred embodiment, the balloon-restraining and release mechanism includes a biasing spring positioned to bias the balloon-restraining structure away-from a position and state at which the restraining structure is restrainable of one or more balloons. Accordingly, when the lever is moved to a position at which the balloon-restraining structure is released from its balloon-restraining position and state, then biasing spring instantaneously causes the balloon-restraining structure to pop-out or flip-away from its balloon-restraining position and state, such that the balloon(s) is/are immediately releasable.

In a still further preferred embodiment, there is included as a part of the overall combination, a substantially stationary member—relative to the lever, positioned in opposing relationship to the lever(s). The position in the opposing relationship is such that balloon(s) is/are restrainable between the lever(s) and the stationary member(s) when the lever has not been moved to the position at which restrained inflatable balloon(s) is/are released by the balloon-restraining structure.

THE FIGURES

FIG. 1 diagrammatically and symbolically illustrates the inflated-balloon release device above-described, in a preferred embodiment, including a deflated inflatable balloon held in a restrained position and state together with the pressurized gas-containing vessel and valves, etc, thereof conveyable of gas to the balloon, illustrated in a side view.

FIG. 1A diagrammatically and symbolically illustrates in in-part view, a cross-sectional view of the same preferred embodiment as taken along line 1A—1A of FIG. 1.

FIG. 2 diagrammatically and symbolically illustrates a different view of the same embodiment as that of FIGS. 1 and 1A, in side view, this view illustrating different positions and states of being of the now-inflated balloon immediately after the lever and the balloon-restraining structure have each reached their balloon-releasing positions and states, after the biasing spring has caused the balloon stem to be released and after the pressure of the inflated balloon's exterior surface has pressed sufficiently against the now angularly-positioned lever surface sufficiently to cause the balloon and the formerly-retainably pinned (restrained) balloon stem to move away therefrom and to thereby exert a stripping-away force by which in this view the balloon stem is now stripped away from the formerly inserted gas-providing needle-portion of the gas-providing tubular member.

FIG. 3 diagrammatically and symbolically illustrates in an in-part view thereof, with partial cut-away for improved additional illustration of interior contents and structure, a further preferred embodiment inclusive of a gift-box having a pivoted lid. As shown in phantom, when the lid is moved to an open position and state, the gas-valve actuation portion thereof is positioned to apply valve-opening pressure on the conventional-type gas-release valve's depressable button such that pressurized gas is flowable through the valve to and through the tubular member toward the balloon from the pressurized-gas container or enclosing-structure.

FIG. 4A diagrammatically and symbolically illustrates in an enlarge in-part view of the portion 18 of FIG. 1, the nature of a typically conventional spincter valve **11*c* as sealably constrained within the elastic stem-walls 10*a*** of the balloon stem having the needle portion of the distal end of the tubular member sealably but removably mounted within the spincter valve in a position and state permitting flow of pressurized gas into the balloon space of the balloon being inflated in this illustration, shown in side cut-away view.

FIG. 4B diagrammatically and symbolically illustrates the same subject matter as that of FIG. **4*a*, except in a position and state as would be present in the positions and states of FIG. 2** immediately after the spincter valve of the balloon has been stripped from the needle portion of the tubular member, by virtue of the balloon being pulled-away from the needle portion of the tubular member, also shown in side cut-away view.

DETAILED DESCRIPTION

All of the preceding figures illustrate common preferred embodiments, and accordingly except for different positions and states of being, the subject matter and illustrated elements are identical, and apart from the FIG. 3 illustrating a more preferred embodiment. Therefore, common indicia are utilized for corresponding elements, features and descriptive arrows and the like, throughout the following detailed description.

Accordingly, by reference to FIGS. 1, 1A, 2, 4A and 4B, the following features of the invention are ascertainable. For the different Figures, an element or feature once described, will not be again described, except for certain instances for purposes of facilitating clarity and understanding.

Figure 1:
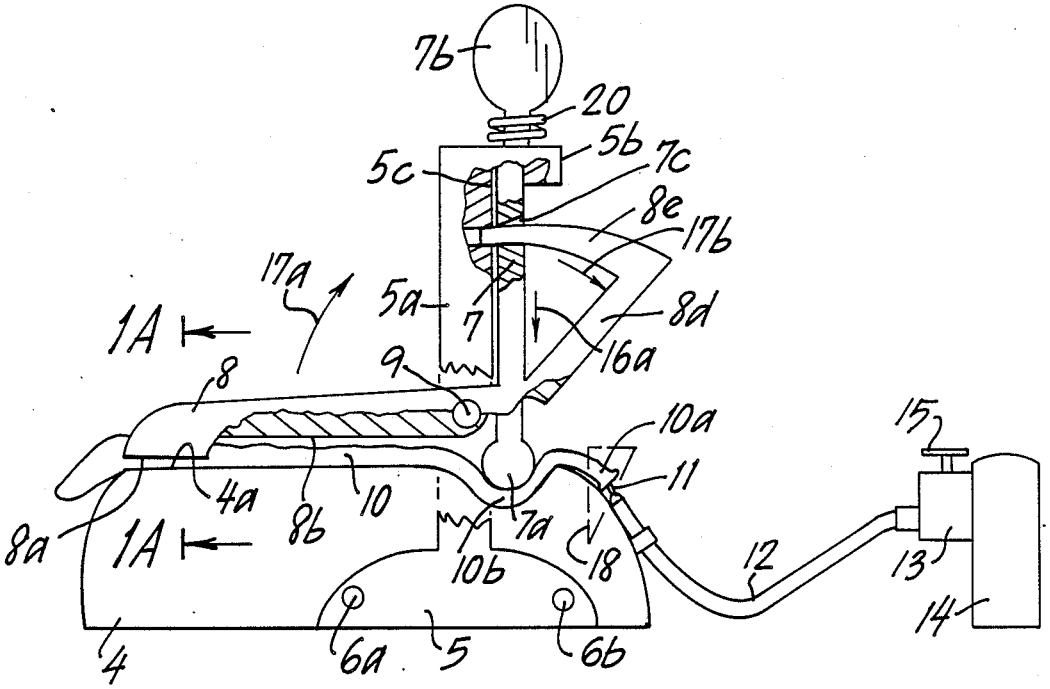
Figure 1A:
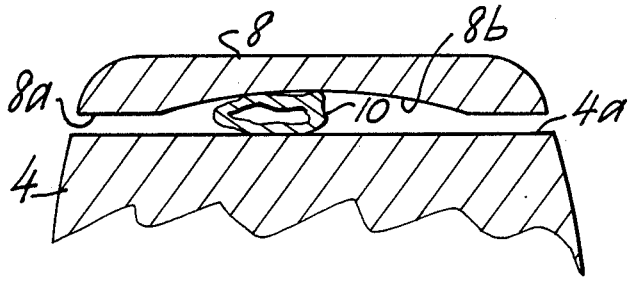

In FIG. 1, balloon-restraining positions and states are disclosed illustrating the restraint of a mounted balloon 10 before and/or during initial inflation thereof, while FIG. 2 illustrated the same balloon 10 in the inflated position and state immediately after it has moved in direction 19 and as a result of that movement has stripped-away the balloon stem 10*b* and the self-sealing spincter valve-embodying portion 10*b* from the needle portion 11 and the tube portion 12—the tubular member being composed of the combination of the tube portion 12 and the needle portion 11. The tube portion is anchored by anchoring member 27 to the base or stationary member 4. The lever includes the balloon-actuating lever portion 8 and an opposite key-end 8*d* having a key portion 8*e* mounted within an angular depressions and through-space 7*c* of restraining shaft 7 and the space 5*d* of shaft-support structure 5*a* having base 5 mounted by pins 6*a* and 6*b* onto the stationary member 4. The lever 8 at a position intermediate between the lever portion and the key-end portion 8*d*, is pivotally mounted on pivot pin 9 onto the shaft-support structure 5*a*. FIG. 1A better illustrates the relationship of the restrained balloon, here shown in cross-section, as restrained between the lever under-surface 8*c* of lever portion 8, and the upper surface 4*a* of the stationary member 4, with downwardly-extending opposite lever flange-portions 8*a* retainably extending downwardly to prevent the balloon before, during and after the inflating thereof from moving sidewardly away from the contacting surface 8*b* above-noted. In the balloon-restrained position and state of FIGS. 1, 1A and 4A, the balloon stem 10*b* is locked against the semicircular or angular surface 28 by the downwardly positioned and downwardly-pressing balloon-retaining ball 7*a* of downwardly-locked restraining shaft 7 after having first inserted the balloon 10 into position and the mounting of the self-sealing member 28 (FIG. 4A) onto the needle portion 11, followed by pressing downwardly on the knob-handle 7*b* sufficiently against the upwardly-biasing force of spring 20, to move the restraining shaft 7 in direction 16*a* to thereby align through-space 7*c* with the space 5*d* prior to pressing downwardly on lever portion 8 to thereby cause the key portion 8*e* to become inserted through the through-space 7*c* into the locking state within the space 5*d*. The restraining shaft 7 is mounted through a through-space 5*c* of shaft support structure 5*b* that is supported by upright support structure 5*a*. The helical spring 20 is compressed between and biased against the oppositely-positioned handle-knob 7*b* and the shaft support structure 5*b*. As inflating pressurized gas moves from the pressurized gas container (enclosing structure) 14 through the valve stem 13 after actuation of the valve button 15 in direction 15*a*, along tube portion 12 and needle portion 11 in directions 12*a*, 12*b* (FIG. 1) and 11*d* and 11*d*′ and 11*d*″ (FIG. 4A) consecutively, into the balloon enclosed-space 10′ of balloon 10, the balloon exterior surface 10*c* (FIGS. 1, 1A and 2) presses against the surface 8*b* of lever portion 8 thereby pivoting upwardly the lever portion 8 while progressively withdrawing the key portion 8*e* first from the locking space 5*d* and then from the through-space 7*c* as the key end 8*d* and its key portion 8*e* all move in direction 17*b*. Eventually the lever portion 8 has moved in direction 17*a* sufficiently and the key portion concurrently has moved in direction 17*b* sufficiently that the key portion is totally withdrawn from the through-space 7*c* at which time the biasing spring 20 instantaneously caused the restraining shaft 7 and its restraining ball 7*a* to pop or shift upward in direction 16*b* to the positions and states shown in FIG. 2. When that occurs, the lateral force on the balloon resulting from the force of the balloon 10*c* against the lever undersurface 8*b* causes the released balloon stem 10*a* and the balloon 10 to immediately move in direction 19 with sufficient force and intensity as to strip the self-sealing member 28 (FIGS. 4A) from the needle portion 11 to result in the positions of FIGS. 2 and 4B.

In FIG. 3, party gift-box 21 has a lid 22 pivoted on pivot pin 23, such that lid 22 is pivotal in direction 24 to open position and state as shown in phantom as lid 22*a*. As shown in phantom, when the lid 8 is moved to an open position and state, the gas-valve actuation portion 25 thereof is positioned as shown in phantom at 25*a* to apply valve-opening pressure on the conventional-type gas-release valve's depressable button 15*a* of valve stem 13*a* of the pressurized gas-containing vessel 14*a*, such that pressurized gas is provided through tubular portion 12*a* to a balloon (not shown) mounted and operative therein in accord with FIGS. 1, 1A, 2, 4A and 4B.

Figure 4A:
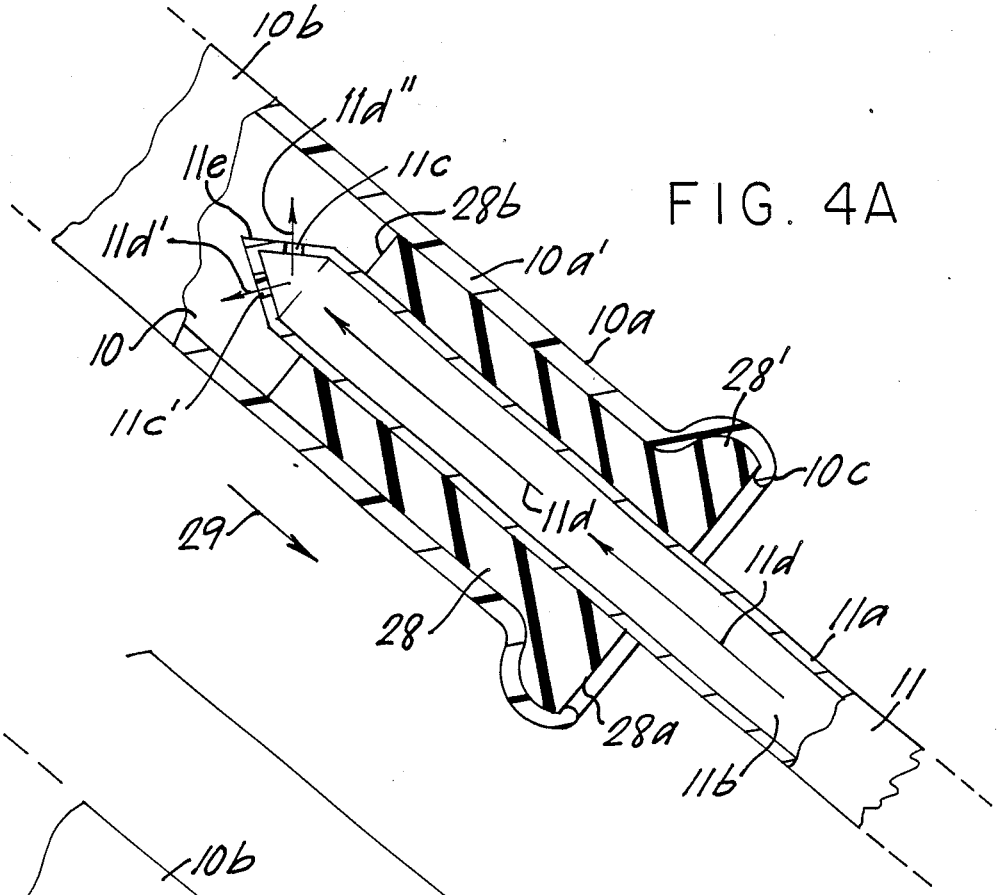
Figure 4B:
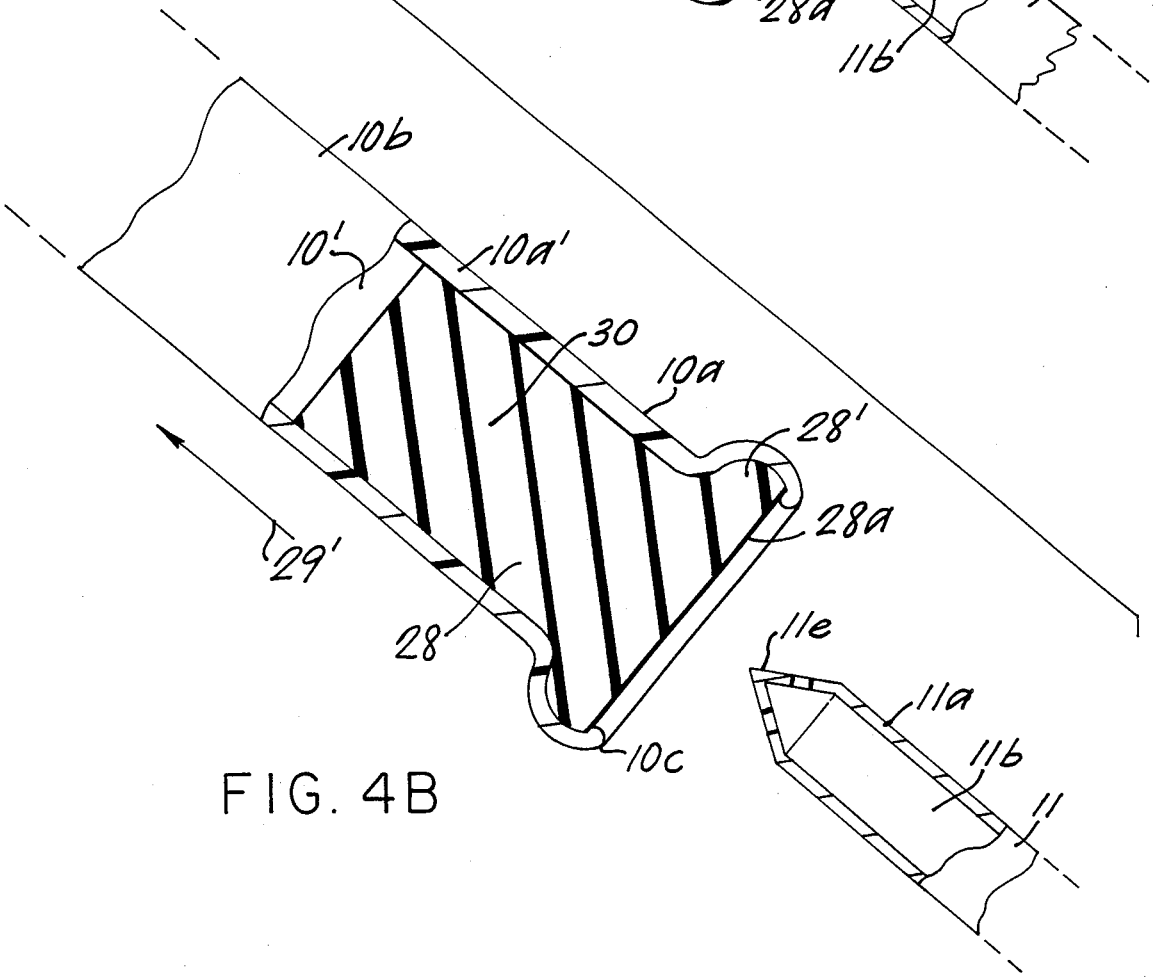

With reference to FIGS. 4A and 4B, the self-sealing member 28 has shoulders 28′ around which the balloon-walls end of the balloon stem portion 10*a* and gas-inlet port structure identified as 10*c*, wrap retainably around the shoulders 28′; as well, the stem portion 10*a* tightly resiliently binds and sealably retains the self-sealing member 28 against leakage of pressurized gas either around the edges of and/or through the body of the self-sealing member 28 both during the inflating of the balloon 10 as shown in FIGS. 1 and 4A and subsequent to the inflating of the balloon 10 as shown in FIGS. 2 and 4B. As shown in FIG. 4A, the needle portion 11 having needle walls 11*a* and needle through-space 11*b*, is in an inserted state (having been forcefully inserted by force) extending through the surface 28*a* and body of the self-sealing member until the needle portion protrudes beyond the surface 28*b* with the needle portion openings 11*c* beyond the surface 28*b* and thereby with the needle portion openings 11*c* within the space 10′ of the balloon stem portion 10*b*, such that pressurized gas passes through the needle portion in directions 11*d* and through the needle portions openings 11*c* into the space 10′. When the lever portion 8 has pivotally moved sufficiently in directions 17*a* as to cause the key portion 8*e* to be totally withdrawn from the through-space 7*c* after which the ball 7*a* pops upward, as previously disclosed, the balloon as shown in FIG. 2 has become sufficiently inflated that the pressure of the balloon's exterior wall surface 10*a* (as shown in FIG. 2) has exerted sufficient pressure against the now angularly-positioned lever portion 8 (of FIG. 2) that the balloons is exerting a sideward pulling force on the balloon-mounted stem portion 10*b* (cummulatively referred to as balloon stem and self-sealing member combination 11*c*) sufficiently that the self-sealing member 28 becomes forcefully stripped from (i.e., pulled off-of) the needle portion to have the appearance shown in FIG. 4B. Accordingly, FIG. 4B illustrates substantially the same elements as FIG. 4A, except that in FIG. 4B the self-sealing member 28 is self-sealed along the former-insertion path 30 of the needle portion 11 of FIG. 4A, and a needle portion with its point 11*e* is shown in the withdrawn state after the balloon stem portion 10*b* and the balloon gas inlet port 10*a* has been stripped from the needle portion 11 as described-above.

It is to be understood that pressure-activated valves of the type represented herein by valve stem 13 and 13*a*, and by the valve actuation button 15 and 15*a*, and the pressurized gas-containing vessel 14 and 14*a*, and the gas-conveying tube such as tubes 12 and 12' are conventional and old technology not requiring detailed disclosure of the mechanism thereof. In any event, such valve typically include spring-biased actuation buttons such as button 15 which biases the valve to a normally closed state. However, it is contemplated that any other equivalent or other type actuation valve may be utilized, such as one by which pressure on the pressure valve button (such as 15) serves to cause a gas-retaining membrane to be punctured in the valve stem to thereby permit pressurized gas to flow therethrough eventually into the enclosed balloon space. Such a mechanism is often used with gas cartridges, and accordingly it is contemplated that the pressurized gas-containing vessel 14 and 14*a* may be a gas cartridge containing pressurized gas releasable by rupture of the gas-retaining membrane as above-noted.

Likewise it is within the scope and contemplation of this invention to utilize other substitution of equivalents and/or to make modification within the ordinary skill of the art.

I claim:

1. An inflated-balloon release device comprising in combination: balloon-restraining and release means for intermittently retaining a balloon during inflating thereof followed by automatically releasing of restraint-holding of the thereby inflated balloon, said balloon-restraining and release means including a balloon-restraining structure positioned to restrain a deflated inflatable balloon before and during inflating thereof, and the balloon-restraining and release means further including a lever connected to said balloon restraining structure, the lever being positioned and mounted such that it is adapted to be moved to a release position at which said balloon-restraining structure is caused to release an inflated balloon restrained thereby, the balloon-restraining and release means being for intermittently restraining said inflatable balloon until said inflatable balloon has become inflated to a predetermined inflated degree sufficient for an exterior balloon surface to exert sufficient pressure on said lever to move the restraining structure from its balloon-restraining state.

2. An inflated-balloon release device according to claim 1, including an inflatable balloon with said exterior surface and having a balloon gas-inlet port, and including a gas-inflating means including a pressurized-gas enclosing-structure enclosing pressurized gas, and having an outlet conduit and outlet port thereto and a gas container gas-release valve thereto having a gas-release means which when actuated is for releasing said pressurized gas through said outlet conduit outlet port, and said outlet conduit being in sealed gas-flow communication with said balloon gas-inlet port such that gas released by said gas-inflating means is inflatable of said inflatable balloon sufficiently to cause said lever to be moved to a degree releasable of said balloon-restraining and release means up to a time and state of inflation of the balloon at the time of release thereof from the restraint by said balloon-restraining and release means.

3. An inflated-balloon release device according to claim 2 in which the inflatable balloon includes an inflatable portion and includes a tubular gas inlet stem-portion having said balloon gas-inlet port and includes a sealed inner-balloon space within balloon-enclosing walls; and including a self-sealing member mounted fixedly and sealably within said balloon gas-inlet port; further including a gas-conveying tubular member enclosing tubular through-space and the tubular member having a proximal end portion and an opposite distal end portion thereof having a proximal gas-entering opening in said distal end portion and a distal gas-exiting opening in said distal end portion, and the distal end portion being mounted in and substantially extending from space exterior to said inflatable balloon through said self-sealing member, sufficiently for gas conveyed through said tubular member exiting from said gas-exiting opening to pass inflatably into said sealed inner-balloon space, said self-sealing member being characterized by physical properties such that said tubular member and said distal end portion thereof are withdrawable from said self-sealing member when pressure of a predetermined first magnitude is withdrawably applied to said inflatable balloon sufficiently to strip said self-sealing member from said tubular member; gas-inflating means including a pressurized-gas enclosing-structure enclosing pressurized gas, and having an outlet conduit and outlet port thereto and an gas container gas-release valve thereto having a gas-release means which when actuated is for releasing said pressurized gas through said outlet conduit outlet port, and said outlet conduit being in sealed gas-flow communication with said distal end portion and within said proximal gas-entering opening sufficiently for pressurized gas exiting from said outlet port to pass through said proximal gas-entering opening, through said tubular through-space, through said gas-exiting opening, and into said sealed inner-balloon space; and balloon-restraining and release means including a balloon-restraining structure positioned to restrain the inflatable balloon in a deflated state and a lever connected to said balloon restraining structure adapted to be moved to a release position at which said inflatable balloon is released from restraint, the balloon-restraining and release means being for intermittently restraining said inflatable balloon until said inflatable balloon has become inflated to a predetermined inflated degree sufficient for said exterior surface to exert pressure on said lever, said lever being positioned and mounted such that said exterior surface of the inflatable balloon when inflated to said predetermined inflated degree sufficiently to press against said lever at a lever-moving pressure sufficiently to move the restraining structure from its balloon-restaining state, cause said restraining structure to be sufficiently moved as to release said inflatable balloon and as to permit said self-sealing member to be stripped from said tubular member, said lever-moving pressure being of said predetermined first magnitude when said restraining structure is moved to release said inflatable balloon.

4. An inflated-balloon release device according to claim 3, in which said gas is lighter than air, and in which said lever is positioned relative to each of said exterior surface and said restraining structure, such that said predetermined first magnitude is reached solely when said balloon is substantially inflated to a predetermined degree of inflation sufficient for said balloon to be lifted upwardly by said gas within said sealed inner-balloon space.

5. An inflated-balloon release device according to claim 4, including an enclosing vessel having a vessel open port, and a lid member of a size and shape adapted to fit and intermittently close said open port when the lid member is in a vessel closing state and position, said lid being positioned relative to said gas release means such that said gas release means becomes actuated when said lid member is moved to a substantially open position and state.

6. An inflated-balloon release device according to claim 5, in which at least one of said lever and said balloon-restraining structure includes a key-portion, and in which a remaining other one of said lever and said balloon-restraining structure includes a key-receiving portion, said key-portion and said key-receiving portion being positioned such that said key-portion is mounted within said key-receiving portion when said lever has not been moved sufficiently to cause said balloon to be released from restraint by said balloon-restraining structure, and said key-portion being withdrawn from said key-receiving portion at a time and state of release of a balloon restrained by the balloon-restraining structure.

7. An inflated-balloon release device according to claim 1, in which at least one of said lever and said balloon-restraining structure includes a key-portion, and in which a remaining other one of said lever and said balloon-restraining structure includes a key-receiving portion, said key-portion and said key-receiving portion being positioned such that said key-portion is mounted within said key-receiving portion when said lever has not been moved sufficiently to cause a restrained balloon to be released from restraint by said balloon-restraining structure, and said key-portion being withdrawn from said key-receiving portion at a time and state of release of a balloon restrained by the balloon-restraining structure.

8. An inflated-balloon release device according to claim 1, in which said balloon-restraining and release means includes a biasing spring positioned to bias said balloon-restraining structure away-from a position and state at which the restraining structure is restrainable of a balloon, such that when said lever is moved to a position at which said balloon-restraining structure is released from its balloon-restraining position and state, the balloon-restraining structure is caused to immediately move away from its balloon-restraining position and state by biasing action of the biasing spring.

9. An inflated-balloon release device according to claim 1 in which said balloon-restraining and release means includes a substantially stationary member relative to said lever, positioned in opposing relationship to said lever such that a balloon is restrainable between the lever and the stationary member when said lever has not been moved to a position at which a restrained inflatable balloon is released by the balloon-restraining structure.

10. An inflated-balloon release device according to claim 3, in which said gas includes a predominant amount of helium.

11. An inflated-balloon release device according to claims 1, in which said balloon-restraining and release means includes a substantially stationary member relative to said lever, positioned in opposing relationship to said lever such that a balloon is restrainable between the lever and the stationary member when said lever has not been moved to a position at which a restrained inflatable balloon is released by the balloon-restraining structure, and in which said lever has a lower surface extending axially along a length thereof and has opposite lateral edges extending substantially parallel to said lower axially-extending surface, and has downwardly-extending flanges extending downwardly one from each of said opposite lateral edges positioned to retain a balloon between the downwardly extending flanges.

12. An inflated-balloon release device according to claim 1, in which said lever has a lower surface extending axially along a length thereof and has opposite lateral edges extending substantially parallel to said lower axially-extending surface, and has downwardly-extending flanges extending downwardly one from each of said opposite lateral edges positioned to retain a balloon between the downwardly extending flanges.

* * * * *